US006186326B1

(12) United States Patent
Pienta et al.

(10) Patent No.: US 6,186,326 B1
(45) **Date of Patent: *Feb. 13, 2001**

(54) WRAPPED PAPER ROLL

(75) Inventors: David J. Pienta; Daniel J. Pienta, both of Lambertville, MI (US)

(73) Assignee: Automatic Handling, Inc., Erie, MI (US)

( * ) Notice: Under 35 U.S.C. 154(b), the term of this patent shall be extended for 0 days.

This patent is subject to a terminal disclaimer.

(21) Appl. No.: 09/266,657

(22) Filed: Mar. 11, 1999

(51) Int. Cl.[7] ..... B65D 85/66
(52) U.S. Cl. ..... 206/410; 53/399; 206/398
(58) Field of Search ..... 206/389, 398, 206/410, 412; 53/399

(56) References Cited

U.S. PATENT DOCUMENTS

| | | | | |
|---|---|---|---|---|
| 3,390,762 | * | 7/1968 | Mernieks | 206/412 X |
| 3,660,958 | * | 5/1972 | Garrison | 206/410 X |
| 4,736,567 | | 4/1988 | Pienta . | |
| 4,882,892 | | 11/1989 | Pienta . | |
| 4,936,459 | * | 6/1990 | Mushinski et al. | 206/389 X |
| 5,007,538 | * | 4/1991 | Mushinski et al. | 206/389 X |
| 5,114,012 | * | 5/1992 | Mushinski et al. | 206/389 X |
| 5,131,209 | * | 7/1992 | Schreiber et al. | 53/399 |
| 5,546,729 | | 8/1996 | Pienta . | |
| 5,791,119 | | 8/1998 | Pienta . | |
| 5,850,918 | * | 12/1998 | Pienta | 206/410 |
| 5,873,464 | * | 2/1999 | Haley | 206/398 |
| 5,890,591 | * | 4/1999 | Pienta | 206/410 |
| 6,038,834 | * | 3/2000 | Haley | 53/399 |

* cited by examiner

*Primary Examiner*—Bryon P. Gehman
(74) *Attorney, Agent, or Firm*—Emch, Schaffer, Schaub & Porcello, Co., L.P.A.

(57) ABSTRACT

A wrapping machine for a paper roll having a first wrapping head including at least one supply of a first wrapping material. A first movement device moves the first wrapping head in a first predetermined direction. The wrapping machine further has a second head including at least one supply of a second wrapping material. A second movement device moves the second wrapping head in a second predetermined direction. The wrapping machine assembles a wrapped paper roll including a paper roll, at least one first layer of plastic material positioned adjacent to the paper roll, at least one intermediate layer of cushioning material positioned adjacent the first layer of plastic material and a second layer of plastic material positioned adjacent to the intermediate layer of cushioning material.

4 Claims, 11 Drawing Sheets

WRAPPED PAPER ROLL

BACKGROUND OF THE INVENTION

The present invention relates to a wrapping machine for a paper roll. More specifically, the invention is directed to a wrapping machine including a first wrapping head having a first wrapping material and a second wrapping head having a second wrapping material whereby the wrapping heads move in predetermined directions independently of one another. The invention is also directed to a wrapped paper roll that is assembled by the wrapping machine of the present invention.

It has been found that a paper roll should be wrapped with protective materials to prevent damage during handling. This is particularly true of "carbonless" paper that can be marked or damaged by engagement with objects. The protective materials should protect the body and the edges of the paper roll.

In the past, various machines have been used to wrap paper rolls in overlapped or interleaved widths of protective materials. It has been found that this type of wrapping method is wasteful because of the excessive amount of protective materials used in the method. Therefore, there is a need for a wrapping machine for a paper roll that is efficient and economical as compared to prior art wrapping machines.

SUMMARY OF THE INVENTION

The present invention is directed to a wrapping machine for a paper roll having a first wrapping head including at least one supply of a first wrapping material. The wrapping machine includes a first movement device, such as a motor, for moving the first wrapping head in a first predetermined direction. The wrapping machine further includes a second head including at least one supply of a second wrapping material. A second movement device, such as a motor, moves the second wrapping head in a second predetermined direction.

The present invention is also directed to a wrapped paper roll that is assembled by the wrapping machine of the present invention. The wrapped paper roll includes a paper roll having an exterior surface. The wrapped paper roll further includes at least one first layer of plastic material having an inner surface and an outer surface whereby the inner surface is positioned adjacent to the exterior surface of the paper roll. The wrapped paper roll further includes at least one intermediate layer of cushioning material having an interior surface and an exterior surface whereby the interior surface is positioned adjacent to the outer surface of the first plastic layer. The wrapped paper roll further includes at least one second layer of plastic material having a second inner surface and second outer surface whereby the second inner surface is positioned adjacent to the exterior surface of the intermediate layer.

The primary object of the present invention is to provide a wrapping machine for a paper roll.

An important object of the present invention is to provide a wrapped paper roll assembled by the wrapping machine of the present invention.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
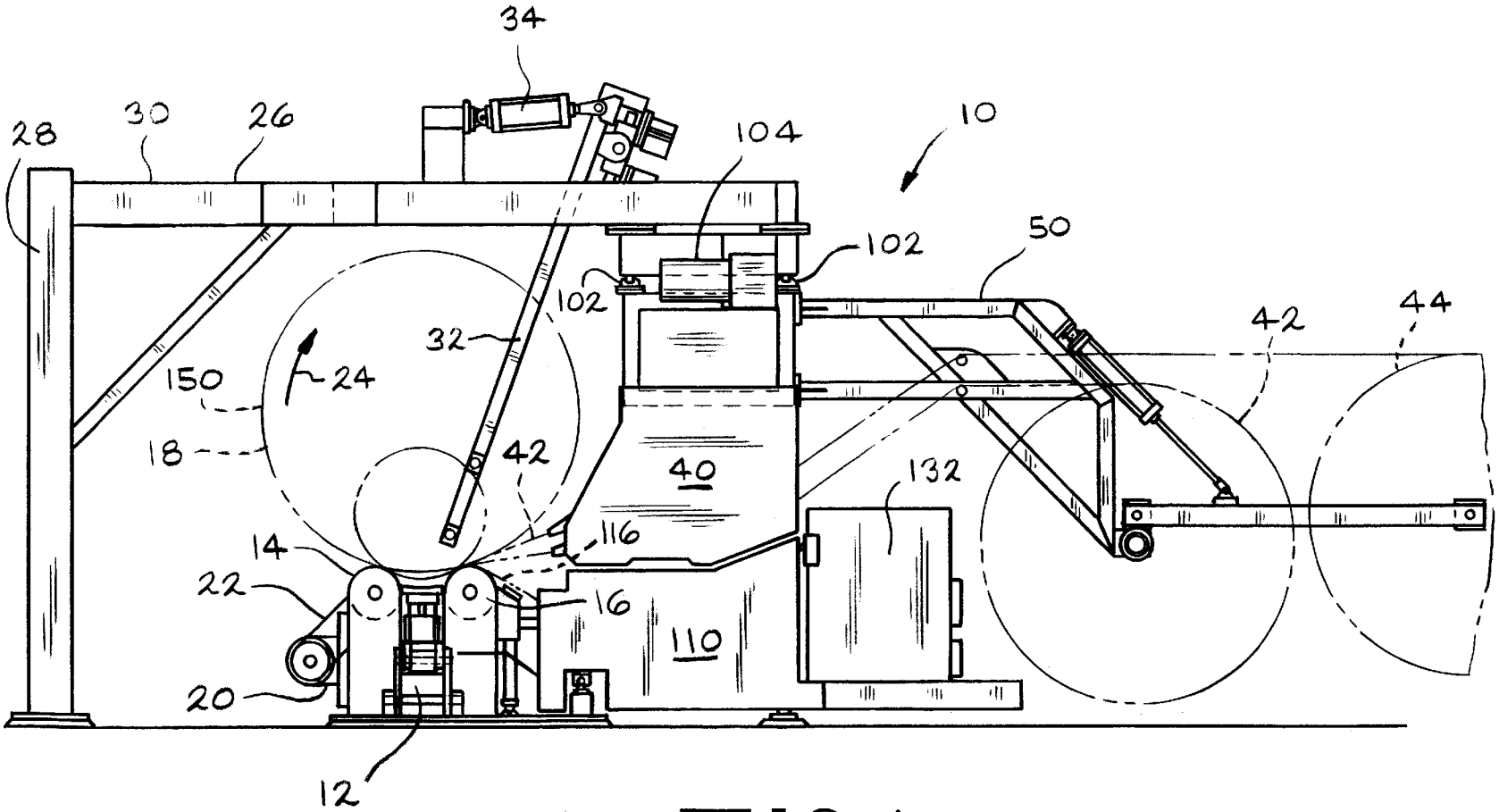
FIG. 1 is a side elevational view of a wrapping machine according to the present invention.

The preferred embodiments and best mode of the present invention will now be described in detail with reference being made to the drawings. The wrapping machine of the present invention is indicated generally in the drawings by the reference number "10".

Figure 2:
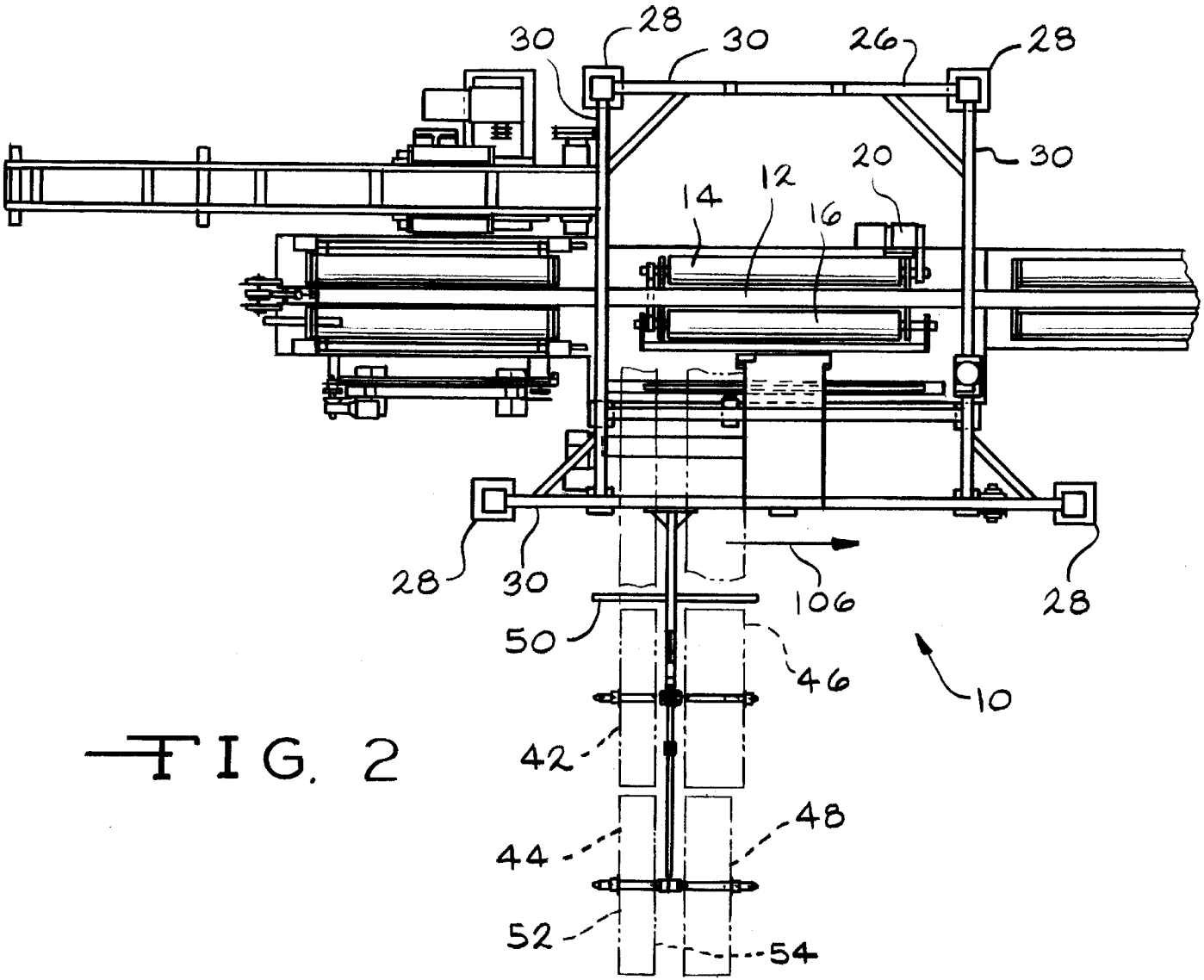
FIG. 2 is a plan view of the wrapping machine shown in FIG. 1 including a conveyor assembly for a paper roll.

Referring to FIGS. 1 and 2, the wrapping machine 10 is positioned adjacent to an index conveyor 12 having first and second rollers 14 and 16. As shown in FIG. 1, a paper roll 18 is positioned on the first and second rollers 14 and 16. A motor 20 is operatively connected to the first roller 14 by a belt 22 to turn the first roller 14. The turning of the first roller 14 causes the paper roll 18 to turn in the direction indicated by the arrow 24 in FIG. 1.

Still referring to FIGS. 1 and 2, the wrapping machine 10 includes a frame 26 having vertical support members 28 and horizontal support members 30. As shown in FIG. 1, a pair of steering arms 32 are mounted on the frame 26. The steering arms 32 maintain the paper roll 18 on the first and second rollers 14 and 16 during wrapping. The steering arms 32 are moveable with respect to the paper roll 18 due to operative connection with an air cylinder 34.

Referring to FIGS. 1 and 2, the wrapping machine 10 includes a first wrapping head 40. The first wrapping head 40 is in communication with at least one supply of a first wrapping material or media. In a preferred embodiment, as shown in the present drawings, the first wrapping head 40 is in communication with first, second, third and fourth rolls of first wrapping material 42, 44, 46 and 48. The rolls 42–48 are rotatably mounted on a first wrapping material frame 50 that is mounted on the frame 26. The first wrapping material is a cushioning material that protects the paper roll 18 during handling. Examples of cushioning material that can be used in the present invention include a foamed material, a plastic material that includes air bubbles, kraft paper, corrugated paperboard, corrugated plasticboard and extruded plastic material. The thickness of the cushioning material is usually in the range from about ⅛ inch (0.3 centimeter) to about ½ inch (1.3 centimeters). However, it should be understood that other types of cushioning material can be used depending on the type of paper roll 18 being wrapped by the wrapping machine 10.

Referring to FIG. 2, each roll 42–48 can consist of a different cushioning material having different widths. In a preferred embodiment, all of the rolls 42–48 consist of the same cushioning material, such as a foamed material having a thickness of ⅜ inch (1 centimeter). The rolls 42–48 usually have various widths as measured from a first edge 52 to a second edge 54. For example, the widths can be 12 inches (30.5 centimeters), 16 inches (40.6 centimeters) and 20 inches (50.8 centimeters). However, other widths can be used depending on the size of the paper roll 18 being wrapped by the wrapping machine 10.

Referring to FIGS. 3–9, the first wrapping head 40 includes at least one first wrapping material transportation device for transporting the first wrapping material through the first wrapping head 40. The number of first wrapping material transportation devices depends on the number of rolls of first wrapping material being utilized by the wrapping machine 10. Accordingly, there are four first transportation devices 56, 58, 60 and 62 corresponding to the four rolls of first wrapping material 42, 44, 46 and 48, respectively. As shown in the drawings, the first first wrapping material transportation device 56 is paired with the second first wrapping material transportation device 58 and the third first wrapping material transportation device 60 is paired with the fourth first material transportation device 62.

Still referring to FIGS. 3–9, the first wrapping material transportation devices will be described with reference to the first first transportation device 56 and the second first transportation device 58. It should be understood that this explanation is applicable to the third first transportation device 60 and the fourth first transportation device 62, which include identical parts.

Figure 4:
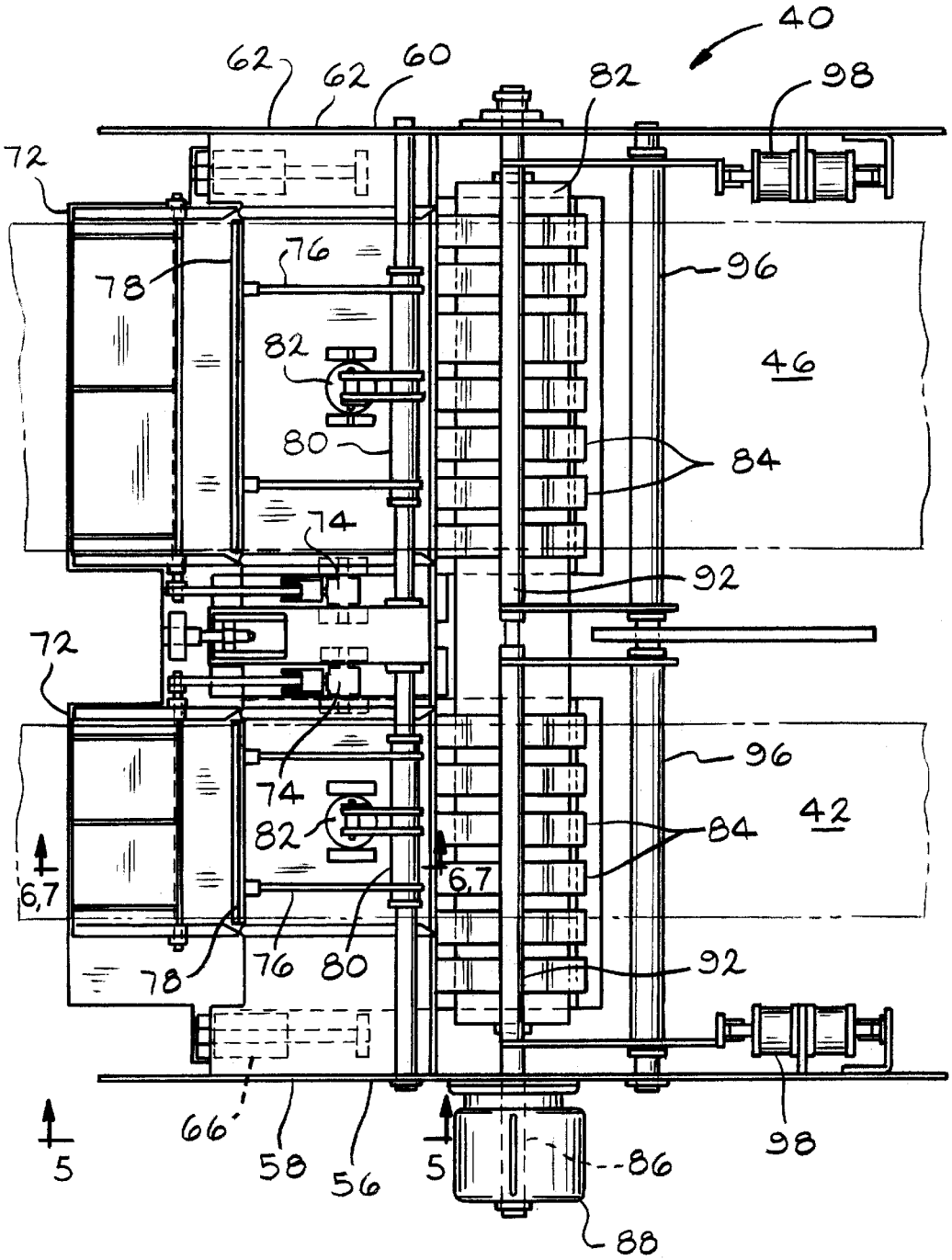
FIG. 4 is a detailed plan view of the first wrapping head of the present invention.
Figure 5:
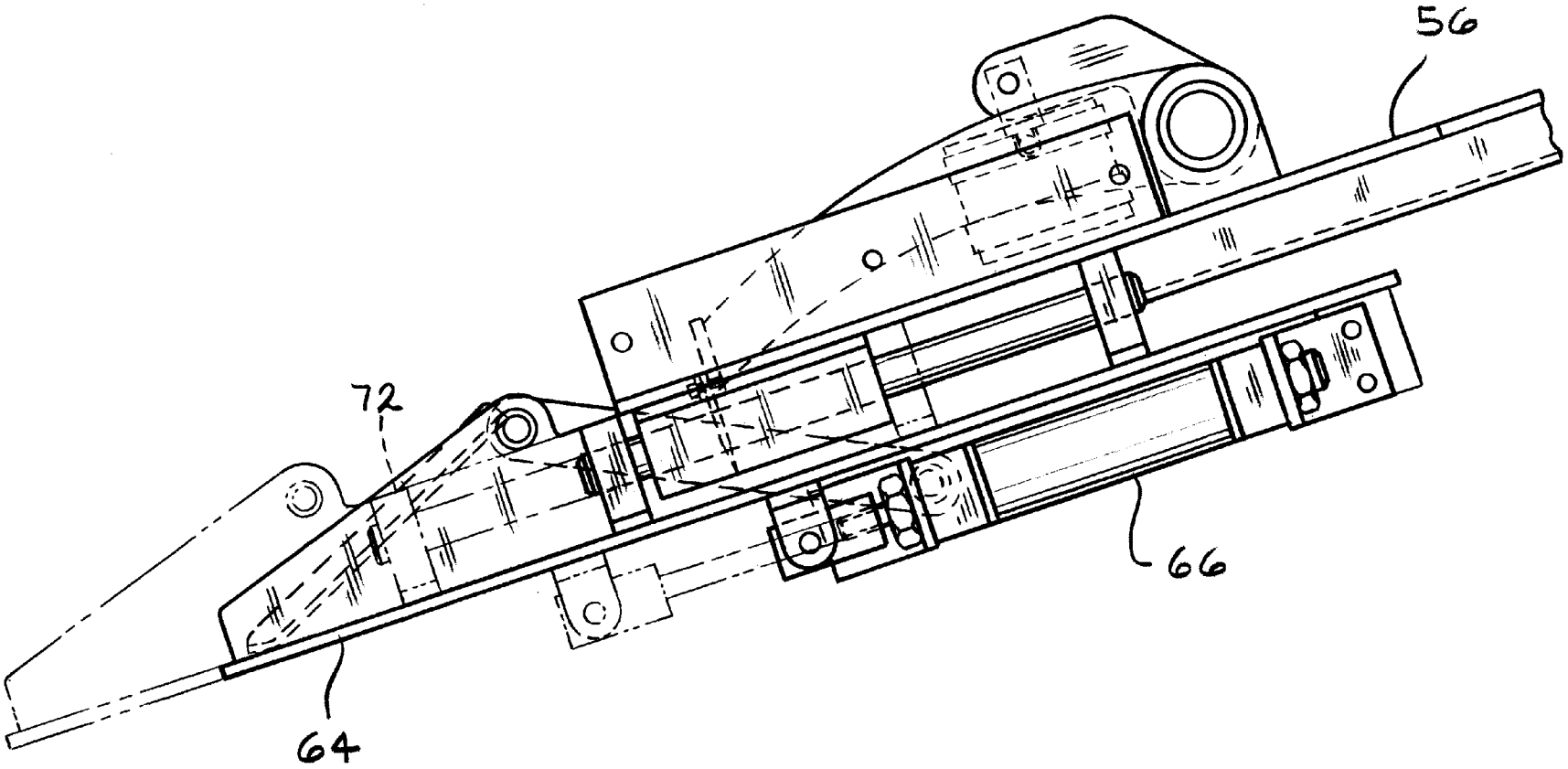
FIG. 5 is a cross-sectional view taken along line 5—5 of FIG. 4.
Figure 8:
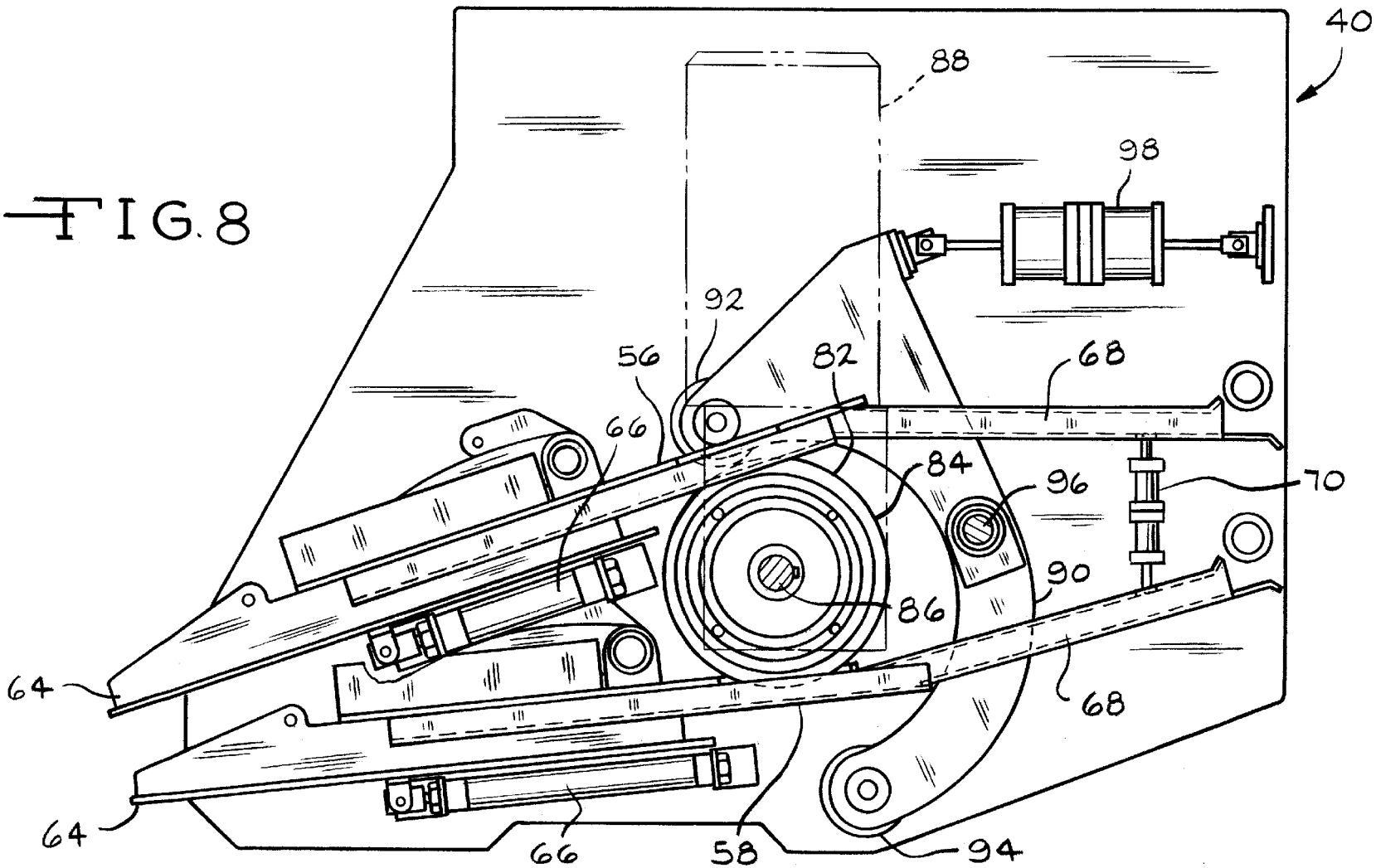
FIG. 8 is a side elevational view of the first wrapping head according to the present invention showing a roller pivot arm in an engaged position.

As shown in FIGS. 4, 5 and 8, each of the first and second first transportation devices 56 and 58 includes a reciprocating support member 64 operatively connected to an air cylinder 66. The support member 64 has a range of movement as indicated by the broken lines in FIG. 5. The support member 64 is in alignment with a reciprocating material chute 68 that is operatively connected to an air cylinder 70. The support member 64 and the material chute 68 support the first wrapping material as it is transported through the first wrapping head 40.

Figure 3:
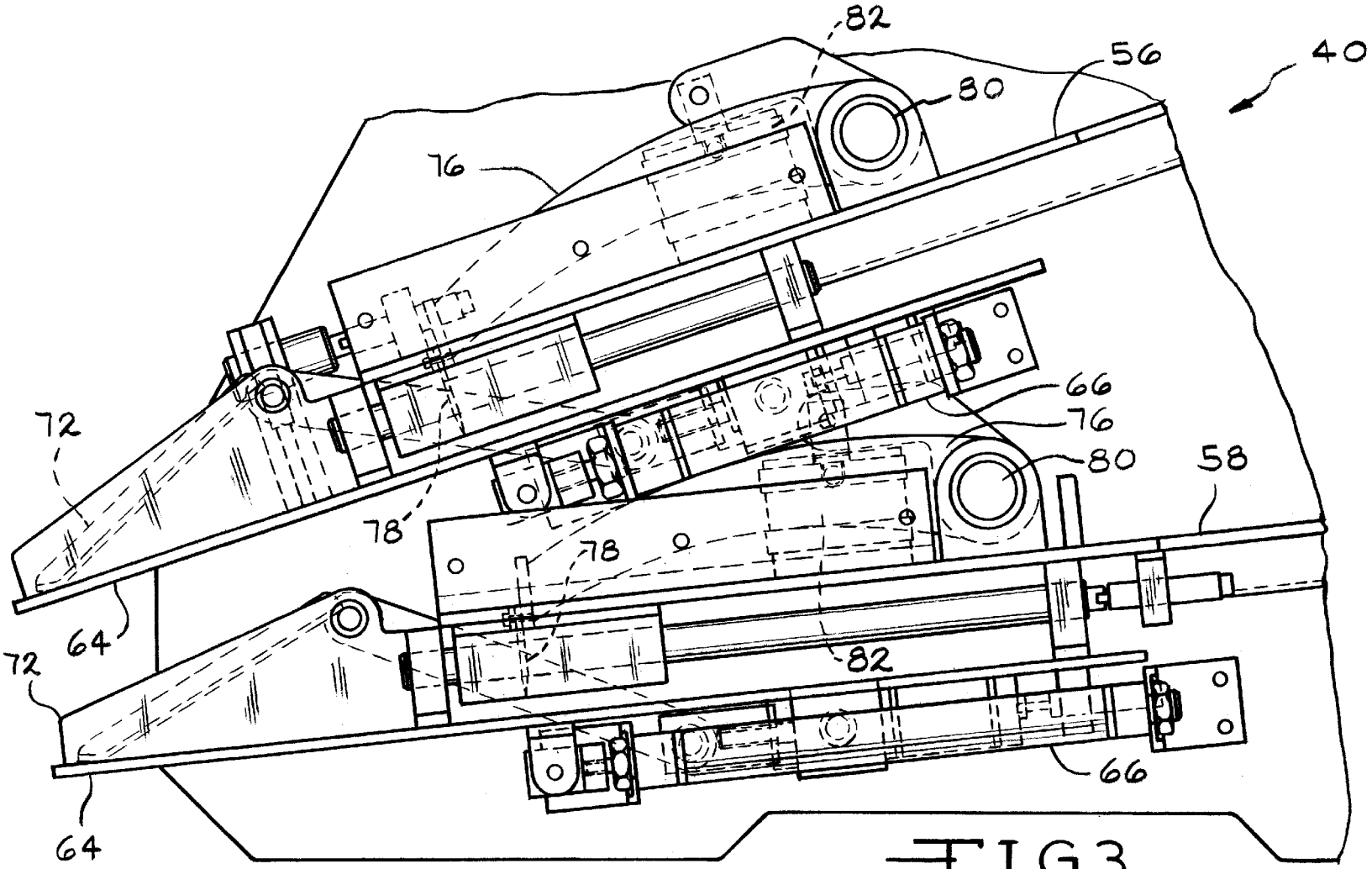
FIG. 3 is a detailed side elevational view of a first wrapping head according to the present invention.
Figure 6:
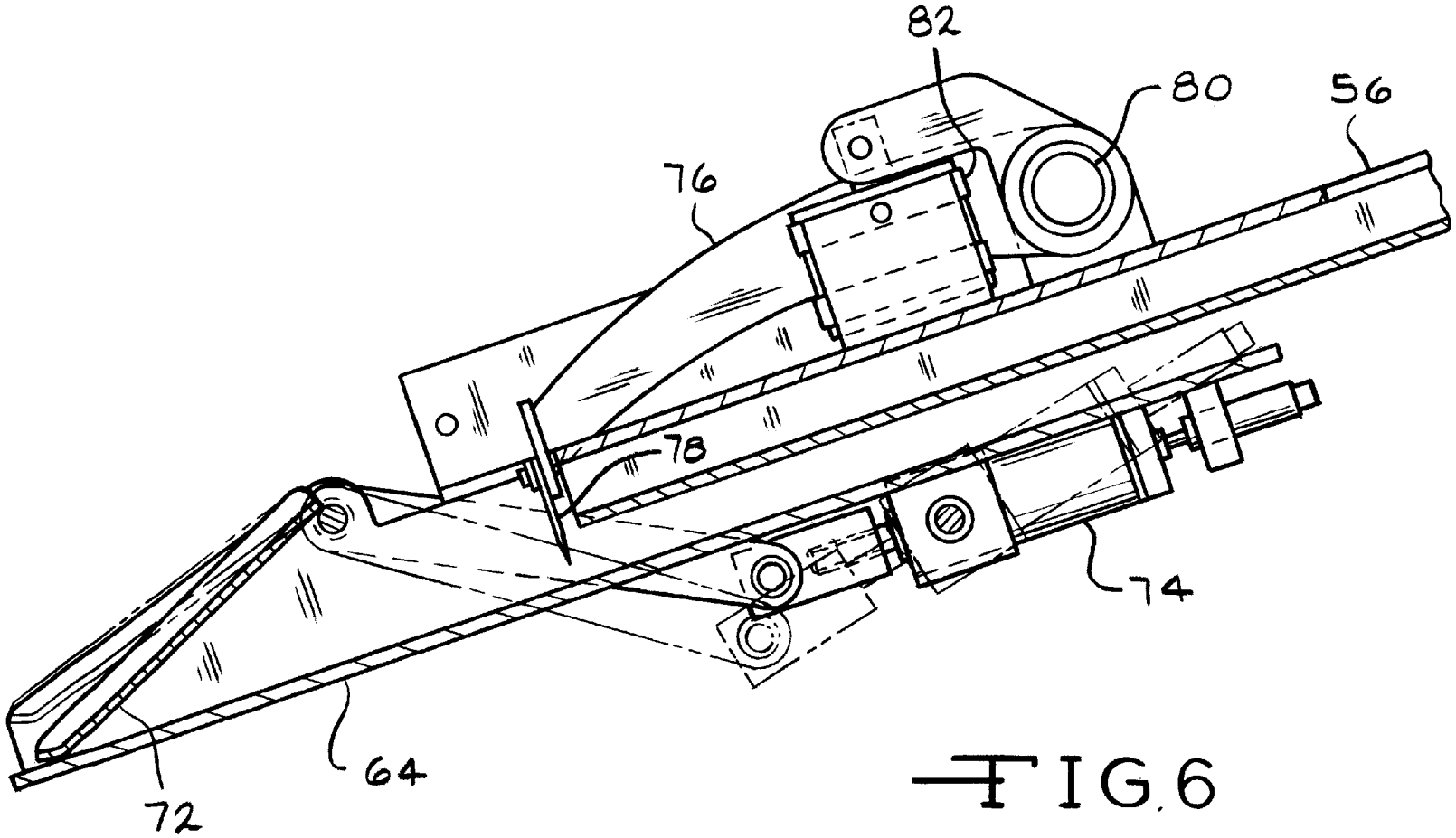
FIG. 6 is a cross-sectional view taken along line 6—6 of FIG. 4.
Figure 7:
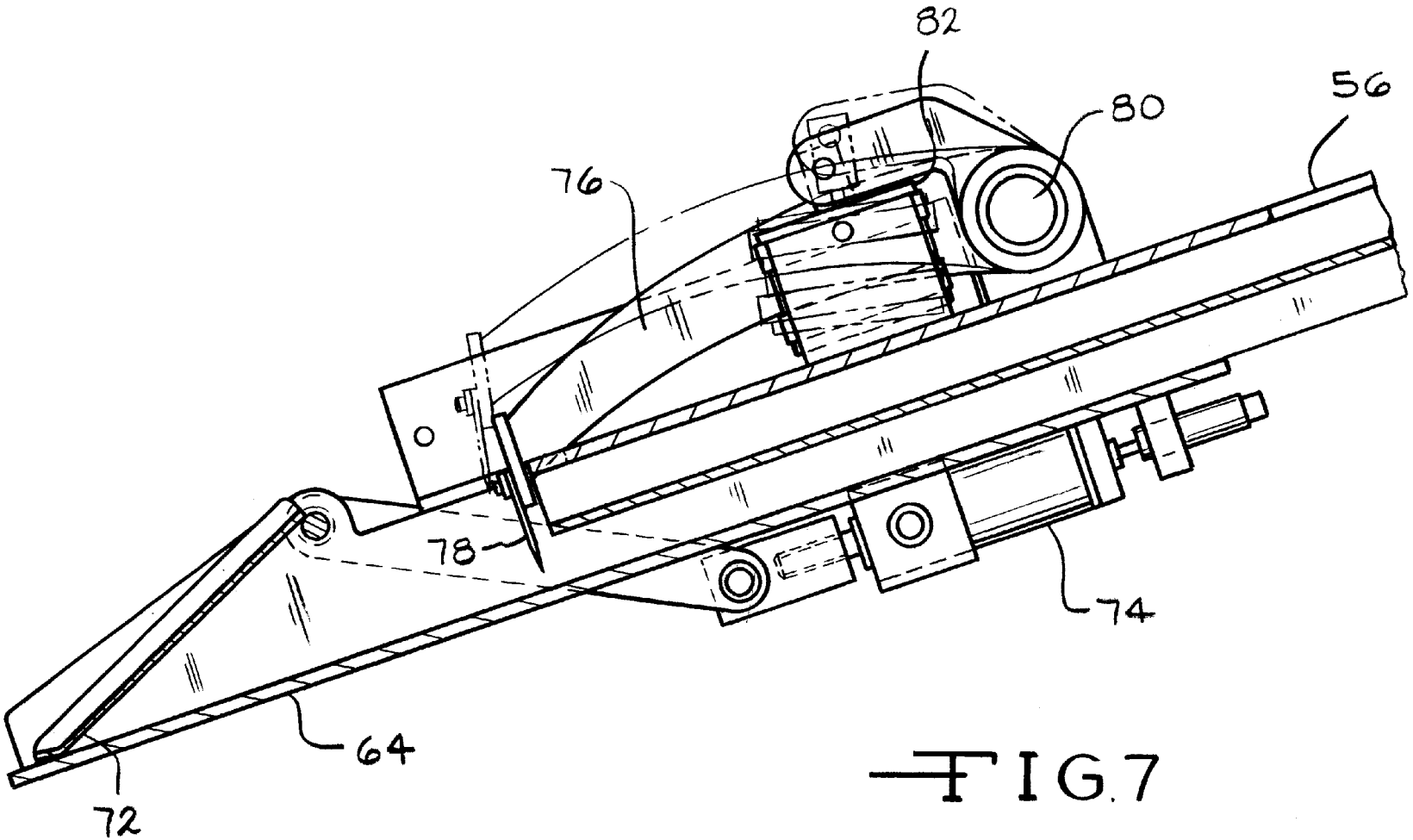
FIG. 7 is a cross-sectional view taken along line 7—7 of FIG. 4.

Referring to FIGS. 3, 4 and 6, each of the first transportation devices 56 and 58 includes a reciprocating gripper arm 72 that is operatively connected to an air cylinder 74. The gripper arm 72 grips or holds the first wrapping material as it travels through the first wrapping head 40. The gripper arm 72 has a range of movement as indicated by the broken lines in FIG. 6.

As shown in FIGS. 3, 4, 6 and 7, each of the first transportation devices 56 and 58 includes reciprocating cutting arms 76 that support a knife 78. The cutting arms 76 are mounted on a shaft 80 that is operatively connected to an air cylinder 82. The cutting arms 76 have a range of movement as indicated by the broken lines in FIG. 7. The knife 78 cuts the first wrapping material as it travels through the first wrapping head 40.

Referring again to FIGS. 4 and 8, the first and second first transportation devices 56 and 58 are positioned adjacent to a drive roller 82 having a plurality of material engagement projections 84. The drive roller 82 is rotatably mounted on a shaft 86 that is operatively connected to a drive motor 88.

Figure 9:
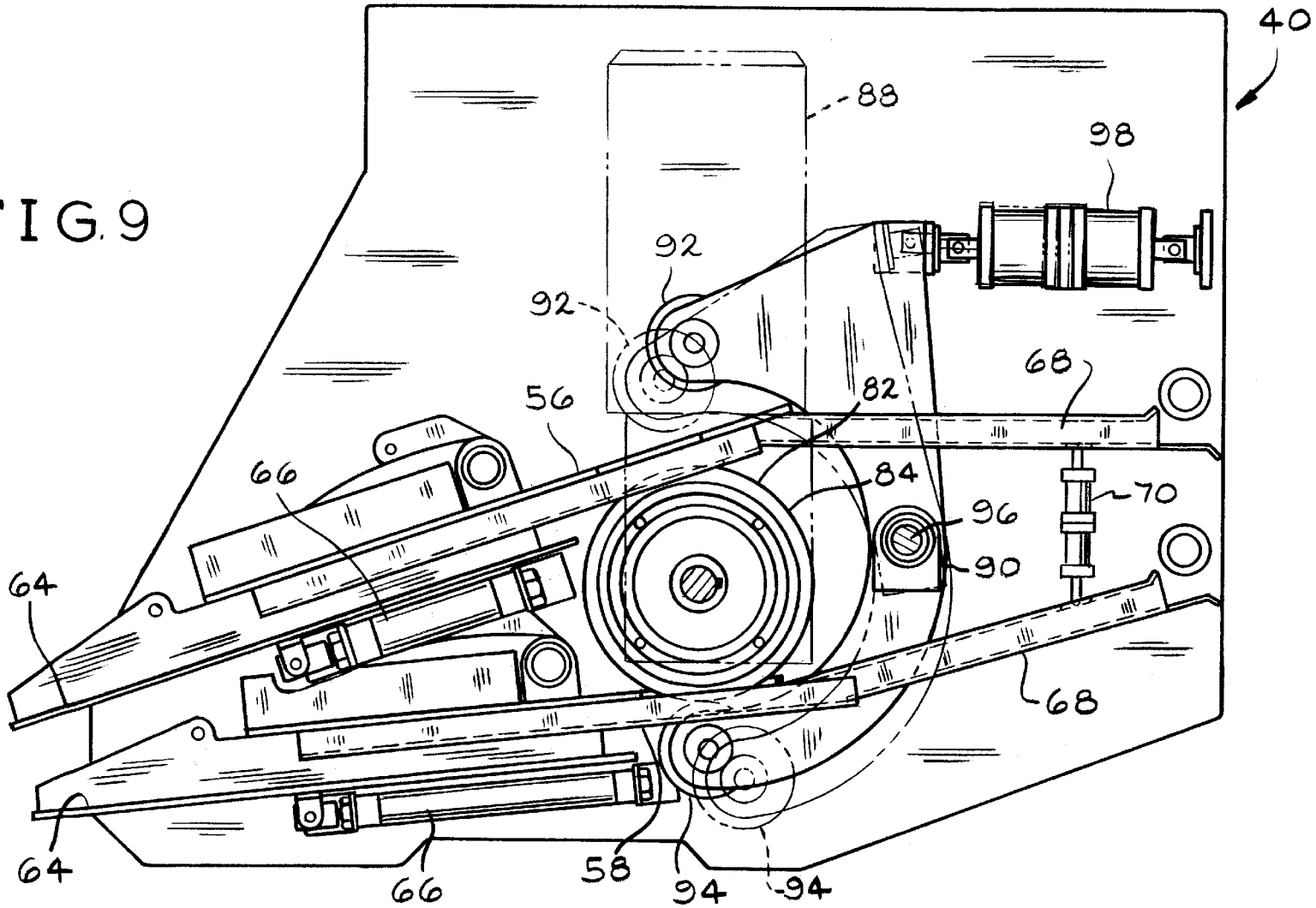
FIG. 9 is a view similar to the view of FIG. 8 showing the roller pivot arm in a second engaged position and in a neutral position as illustrated in broken lines.

As shown in FIGS. 8 and 9, a roller pivot arm 90 having a first roller 92 and second roller 94 is pivotally mounted on a shaft 96. The roller pivot arm 90 is operatively connected to an air cylinder 98. The air cylinder 98 actuates the roller pivot arm 90 to pivot from a first position in which the first roller 92 is adjacent to the support member 64 of the first first transportation device 56 (FIG. 8) to a second position in which the second roller 94 is positioned adjacent to the support member 64 of the second first transportation device 58 (FIG. 9). The air cylinder 98 can also position the roller pivot arm 90 in a neutral position as indicated by the broken lines in FIG. 9. The first and second rollers 92 and 94 engage the first wrapping material to press it against the rotating material engagement projections 84 of the drive roller 92 to advance the first wrapping material through the first wrapping head 40.

Referring to FIGS. 1 and 2, the first wrapping head 40 is movably mounted on the frame 26 by guide members 102. The wrapping machine 10 includes a motor 104 that drives the first wrapping head 40 in a predetermined direction as indicated by the arrow 106 in FIG. 2.

Figure 10:
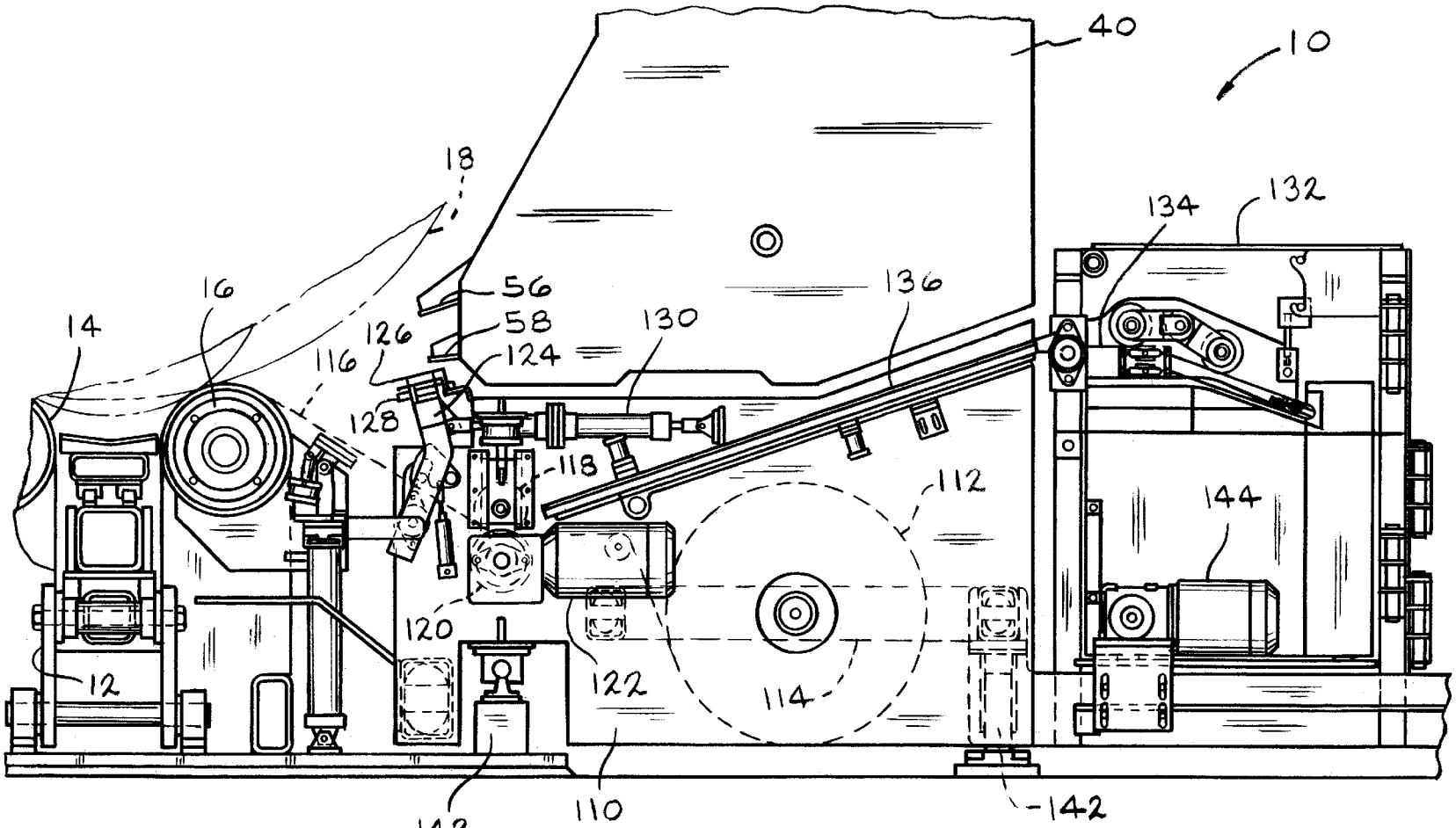
FIG. 10 is a detailed side elevational view of a second wrapping head and a label making device according to the present invention.

Referring to FIGS. 1 and 10, the wrapping machine 10 includes a second wrapping head 110 that is in communication with at least one supply of a second wrapping material. In a preferred embodiment, the second wrapping material is a roll of a stretchable plastic material 112. However, it should be understood that other types of wrapping materials can be used depending on the type of paper roll 18 being wrapped by the wrapping machine 10.

Referring to FIG. 10, the plastic roll 112 is rotatably mounted in the second wrapping head 110 on a frame 114. During operation, as shown in FIG. 10, a plastic web 116 extends between the roll 112 and the second roller 16 of the conveyor 12. Movement of the paper roll 18 in the direction of the arrow 24 as shown in FIG. 1, moves the plastic web 116 from the roll 112, through the second wrapping head 110 and onto the paper roll 18. The plastic web 116 passes through opposing rollers 118 and 120 that are operatively connected to a motor 122. The motor 122 regulates rotation of the rollers 118 and 120 to retard movement of the plastic web 116. This results in the plastic web 116 being stretched between the rollers 118 and 120 and the second roller 16 prior to wrapping on the paper roll 18.

Still referring to FIG. 10, the second wrapping head 110 includes a reciprocating cutting device 124 having a knife 126 for cutting the plastic web 116. The cutting device 124 further includes a glue nozzle 128 for applying glue to the plastic web 116. The cutting device 124 is actuated by an air cylinder 130.

As shown in FIGS. 1 and 10, the wrapping machine 10 includes a label making device 132 that makes labels for the paper roll 18. The label making device 132 can be a conventional printer or copier. The label making device 132 includes a ramp 134 for delivering a completed label (not shown) to a downwardly extending label delivery chute 136 positioned in the second wrapping head 110. The label delivery chute 136 transports the label to the plastic web 116 at a point adjacent to the rollers 118 and 120.

Still referring to FIGS. 1 and 10, the second wrapping head 110 and the label making device 132 are movably mounted on second guide members 142. As shown in FIG. 10, a motor 144 is operatively connected to the second wrapping head 110 and the label making device 132. Referring to FIG. 2, the motor 144 drives the second wrapping head 110 and the label making device 130 in a predetermined direction as indicated by the arrow 106.

The operation of the wrapping machine 10 will now be described with reference being made to FIGS. 1, 2, 4, 8 and 10. The index conveyor 12 conveys the paper roll 18 to a position adjacent to the first wrapping head 40 and the second wrapping head 110. The paper roll 18 is rotatably mounted on the first and second rollers 14 and 16 of the conveyor 12. Rotation of the paper roll 18 in the direction indicated by the arrow 24 causes the plastic web 116 to be unrolled from the plastic roll 112. During travel through the second wrapping head 110, the plastic web 116 is stretched by engagement with the rollers 118 and 120. The paper roll 18 is rotated in the direction indicated by the arrow 24 to apply at least one layer of plastic web 116 on the exterior surface 150 of the paper roll 18.

Referring to FIGS. 1, 2, 4 and 8, the first wrapping material 42, for example, is moved by engagement with the first roller 92 of the roller pivot arm 90 and the material engagement projections 84 of the rotating drive roller 92. The first wrapping material 42 is transported through the first wrapping head 40 along the support member 64 and the material chute 68. A leading edge of the first wrapping material 42 is discharged from the first wrapping head 40 as shown in FIG. 1. The leading edge of the first wrapping material 42 is carried by the plastic web 116 in the direction of rotation of the paper roll 18 as indicated by the arrow 24. A trailing portion of the wrapping material 42 is gripped by the gripper arm 72 to make the wrapping material 42 taut during wrapping. The first wrapping material 42 is cut by actuation of the knife 78 after at least one layer of the first wrapping material 42 has been applied to the paper roll 18. In a preferred embodiment, a single layer of first material 42 is applied to the paper roll 18.

Referring to FIGS. 1 and 10, during application of the first wrapping material 42, at least one second layer of plastic web 116 is applied to the paper roll 18. During application of the second layer of plastic web 116, a label (not shown) from the label making machine 130 is discharged from the label delivery chute 136 to the plastic web 116 by which it is carried to the paper roll 118. After the second layer of plastic web 116 has been applied to the paper roll 18, the plastic web 116 is cut and glued by the reciprocating cutting device 124 of the second wrapping head 110. Depending on the width of the paper roll 18, the first and second wrapping heads 40 and 110 can be independently driven by their respective motors 104 and 144 in the predetermined direction indicated by the arrow 106 in FIG. 2. The above-described operation of the wrapping machine 10 can be repeated until the paper roll 18 is fully wrapped.

An important advantage of the present invention is that the paper roll 18 is wrapped without overlapping or interleaving widths of first wrapping material. As described above, the first, second, third and fourth rolls of first wrapping materials 42–48 can have various widths. Accordingly, various combinations of widths of first wrapping material from the rolls 42–48 can be used to wrap the paper roll 18 without any overlapping or interleaving. For example, if a paper roll 18 has a width of 42 inches (106.7 centimeters) a combination of first wrapping material having widths of 12 inches (30.5 centimeters), 16 inches (40.6 centimeters) and 18 inches (45.7 centimeters) can be applied to the roll with 2 inches (5.1 centimeters) of first wrapping material being positioned on each edge of the paper roll 18.

Figure 11:
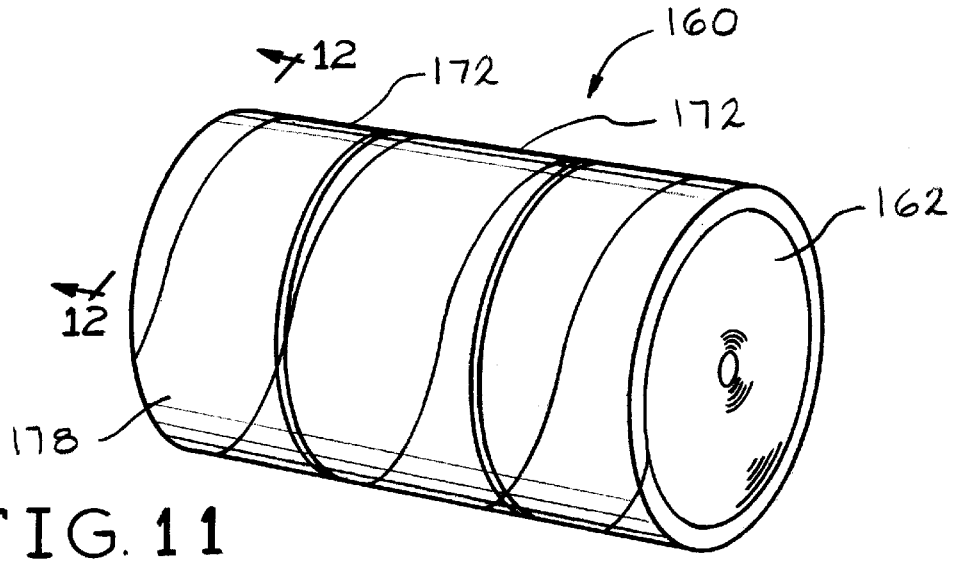
FIG. 11 is a wrapped paper roll according to the present invention.
Figure 12:
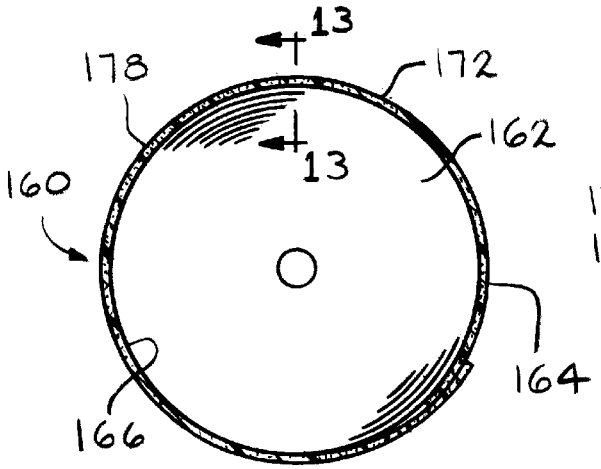
FIG. 12 is a cross-sectional view taken along line 12—12 of FIG. 11.
Figure 13:
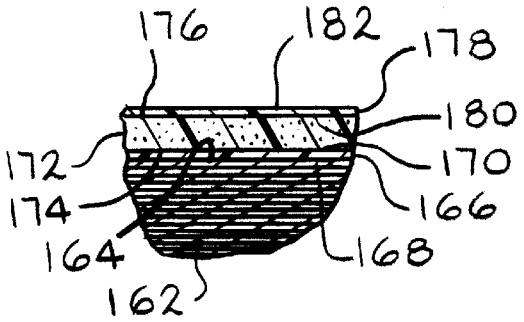
FIG. 13 is a cross-sectional view taken along line 13—13 of FIG. 12.

Referring to FIGS. 11–13, the wrapping machine 10 of the present invention assembles or produces a wrapped paper roll 160. The wrapped paper roll 160 includes a paper roll 162 having an exterior surface 164. The wrapped paper roll 160 includes at least one first layer of plastic material 166 having an inner surface 168 and an outer surface 170. In a preferred embodiment, the plastic material 166 is a stretchable plastic material. The inner surface 168 is positioned immediately adjacent to the exterior surface 164 of the paper roll 162.

The wrapped paper roll 160 further includes at least one intermediate layer of cushioning material 172 having an interior surface 174 and an exterior surface 176. In a preferred embodiment, the wrapped paper roll 160 includes a single layer of cushioning material 172. Examples of cushioning material 172 that can be used in the present invention include a foamed material, a plastic material that includes air bubbles, kraft paper, corrugated paperboard, corrugated plasticboard and extruded plastic material. The thickness of the cushioning material is usually in the range from about ⅛ inch (0.3 centimeter) to about ½ inch (1.3 centimeters). In a preferred embodiment, the cushioning material 172 is a foamed material having a thickness of ⅜ inch (1 centimeter). The interior surface 174 of the cushioning material 172 is positioned immediately adjacent to the outer surface 170 of the first plastic layer 166.

Still referring to FIG. 13, the wrapped paper roll 160 further includes at least one second layer of plastic material 178 having a second inner surface 180 and a second outer surface 182. In a preferred embodiment, the plastic material 178 is a stretchable plastic material. The second inner surface 180 is positioned immediately adjacent to the exterior surface 176 of the intermediate layer 172.

As shown in FIG. 11, the wrapped paper roll 160 can include two or more spaced intermediate widths of cushioning material 172. As described above, the wrapping machine 10 of the present invention produces a wrapped paper roll 160 wherein the widths of cushioning material 172 do not overlap one another and are not interleaved.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A wrapped paper roll comprising:

a paper roll having an exterior surface;

at least one first layer of plastic material having an inner surface and an outer surface, said inner surface being positioned adjacent to said exterior surface of said paper roll;

at least one intermediate layer of cushioning material having an interior surface and an exterior surface, said interior surface being positioned adjacent to said outer surface of said first layer of plastic material; and at least one second layer of plastic material having a second inner surface and a second outer surface, said second inner surface being positioned adjacent to said exterior surface of said intermediate layer of cushioning material wherein said at least one intermediate layer of cushioning material is positioned on said paper roll without being interleaved with said first and second layers of plastic material.

2. The wrapped paper roll of claim 1, wherein said wrapped paper roll includes at least two spaced widths of cushioning material to form said at least one intermediate layer of cushioning material.

3. The wrapped paper roll of claim 1, wherein said at least one intermediate layer of cushioning material is selected from the group consisting of a foamed material, a plastic material that includes air bubbles, kraft paper, corrugated paperboard, corrugated plasticboard and extruded plastic material.

4. The wrapped paper roll of claim 3, wherein said at least one intermediate layer of cushioning material has a thickness in the range from about ⅛ inch to about ½ inch.

* * * * *